United States Patent [19]

Olsson

[11] Patent Number: 5,059,138

[45] Date of Patent: Oct. 22, 1991

[54] LATCH MECHANISM FOR ELECTRICAL CONNECTORS

[75] Inventor: Billy E. Olsson, New Cumberland, Pa.

[73] Assignee: AMP Incorporated, Harrisburg, Pa.

[21] Appl. No.: 660,766

[22] Filed: Feb. 25, 1991

[51] Int. Cl.[5] ..... H01R 13/58

[52] U.S. Cl. ..... 439/460; 439/351

[58] Field of Search ..... 439/350, 351, 357, 358, 439/404, 459, 460, 492, 493, 494, 499

[56] References Cited

U.S. PATENT DOCUMENTS

| | | | |
|---|---|---|---|
| 4,296,989 | 10/1981 | Larson et al. | 439/404 |
| 4,619,493 | 10/1986 | Kikuta | 439/350 |
| 4,693,533 | 9/1987 | Szczkesny et al. | 439/404 X |
| 4,869,685 | 9/1989 | Olsson | 439/404 |

*Primary Examiner*—Eugene F. Desmond

*Attorney, Agent, or Firm*—Bruce J. Wolstoncroft

[57] ABSTRACT

A high density ribbon cable connector includes bipartite strain relief halves adapted to trap between them a high density ribbon cable. The strain relief halves and ribbon are snap latchable into position within a fixture housing with the cable extending through an elongate slot in the fixture housing, and adjacent to a fixture face having conductor aligning grooves emanating from and faning out in opposite directions from the elongate slot. The grooves form a template for the positioning of the conductors for accurate alignment prior to termination. The fixture housing also includes terminal clearance slots aligned with each groove, where two rows of clearance slots are provided on each side of the slot. The fixture housing is snap latchable into a terminal housing, where conductor receiving slots of electrical terminals are inserted into the terminal clearance slots, and electrically terminate the conductors to the electrical terminals.

21 Claims, 8 Drawing Sheets

14
54
122
64
124
116
60
99
38
74
6
98
96

2
50
62
90
128
126
127
76
129

132
134
129
130

LATCH MECHANISM FOR ELECTRICAL CONNECTORS

BACKGROUND OF THE INVENTION

1. Field of the Invention

The subject invention is directed to an improved latching mechanism for latching two electrical connector housing parts together, and for latching the connector to a mating connector.

2. Description of the Prior Art

Various requirements are found in electrical connection systems for retaining housing parts together and for retaining electrical connectors in mating engagement with their associated connector. For example, it is typical to retain housing parts together by way of integral latch arms extending from one of the housing parts, where the latch arms are fastened to the other housing part by way of cooperating latch surfaces. It is common to mold the various latching surfaces, or shoulders, directly in the housing parts to assist in this retention.

In one connection system, U.S. Pat. No. 4,693,533 to Szczesny et al., an electrical connector is shown including a two-part housing where the two parts are pressed together to terminate ribbon cable to associated insulation displacement type terminals. At ends of the two-part electrical connector, latch members are provided which retain the two housing halves together and, resultantly, retain the ribbon conductors in electrical connection with their respective terminals. In addition, the latch members include a second latch arm, for latching the assembled connector into mated engagement with an associated connector, such as a tab header.

One embodiment disclosed in U.S. Pat. No. 4,693,533, FIGS. 5–8, shows a first arm having a shear formed tab struck from the first arm, where the first arm and tab are passed through a narrow channel to the opposite side to latch against the lower surface below the channel. It is intended that the shear formed tab will resiliently flex inward, to occupy the cavity in the first arm defined by formation of the tab, until such time as the tab passes completely through the channel, whereupon it springs back to its pre-flexed position.

While theoretically this approach is sound, the latch arm can have a tendency to malfunction, for a number of reasons. First, the shear formed tab is relatively stiff causing the tab to broach its way through the narrowed section of the channel, rather than resiliently deflecting back into the arm. If this should happen, a collection of sheared plastic is presented to the lower face below the tab, and could inhibit proper mating with the associated connector. Secondly, the shear formed tab as shown is relatively stiff due to its short length, and could have a tendency to plasticly deform upon deflection, such that the tab does not spring back to the natural state.

An object of the present invention then is to provide an electrical connector assembly having two housing parts held together by a latching spring, whereby the latching spring is also used to retain the connector to a mating connector.

Another object of the invention is to provide a latching spring which is resiliently deflectable, such that upon assemblance of the two housing parts, the spring latch arm and locking tab can deflect to a position away from the intended latching surface, and can resiliently deflect to a return position upon clearing the latch surface.

Other objects and advantages of the invention will be apparent from the following description, the accompanying drawings and the appended claims.

SUMMARY OF THE INVENTION

The above objects of the invention were accomplished by providing a connection system comprising an insulative housing assembly comprised of first and second housing parts, where the housing parts are adapted for mating abutment, the housing parts having spring latching clips adjacent to ends of the housing parts to maintain the housing parts together and to latch the housing parts to a mateable connector. The first housing part has clip receiving channels at each end which are in alignment with clip receiving slots of the second housing part, the spring latching clips being receivable into said channels and slots for latching engagement therewith. The spring latching clips are defined as a substantial U-shape having a base arm and a clip arm, the base arm being insertable through the clip receiving channel of the first part and into the clip receiving slots of the second part. The base arm has a shear formed tab extending out of the plane of the base arm having a latching edge facing the first part, where the second housing part is engageable with a latching shoulder below the slot on the second housing part. The first and second housing parts have a relief area above the latching shoulder on the opposite side as the shear formed tab, the base arm being resiliently movable into the relief area upon insertion of the base arm into the channels and slots, and resiliently movable back when the shear formed tab has cleared the latching shoulder.

In this manner, and by providing a relief area above the latching shoulder, the base arm, together with the shear formed tab, are resiliently deflectable into the relief area. This allows the shear formed tab to deflect away from the surface forming the latching surface, until such time as the tab has cleared the latching shoulder, whereupon, the tab deflects back beneath the surface.

In the preferred embodiment of the invention, the channel which receives the base arm and shear formed tab is T-shaped to receive therethrough, the base arm and shear formed tab.

In another aspect of the invention, an electrical connector is provided comprising an insulative housing assembly comprised of first and second housing parts having a plurality of electrical terminals positioned therein. The housing parts are adapted for mating engagement along mutually abutting faces, where the housing parts have latching clips adjacent to ends thereof to maintain the housing parts together. The latching clips comprise a base arm having a lower shear formed tab extending out of a plane of the base arm having a latching edge facing the first part. The first housing part has T-shaped clip receiving channels at each end comprised of cross slots and first tab clearance slots, where the cross slots are in alignment with clip receiving slots of the second housing part. The latching clips are insertable through the clip receiving channels of the first part with the base arms passing through the cross slots and the lower shear formed tabs passing through the first tab clearance slots. The lower shear formed tabs are engageable with a latching shoulder below the clip receiving slots of the second housing part. The first housing part further comprising a second tab clearance slot on the opposite side as the first tab clearance slot, the second tab clearance slot extending part-way through the housing forming an upwardly directed shoulder. The base arm includes an upper shear formed tab in abutment with the upwardly directed shoulder.

By providing a T-shaped slot extending through the first housing part, the shear formed tab of the clip can pass through the first housing part without deflecting the shear formed tab.

In the preferred embodiment of the invention, the first housing part includes a relief area opposite the downwardly facing shoulder, whereby the base arm and lower shear formed tab are deflectable into the relief area, until such time as the shear formed tab passes the associated latching shoulder.

DETAILED DESCRIPTION OF THE PREFERRED EMBODIMENT

Figure 1:
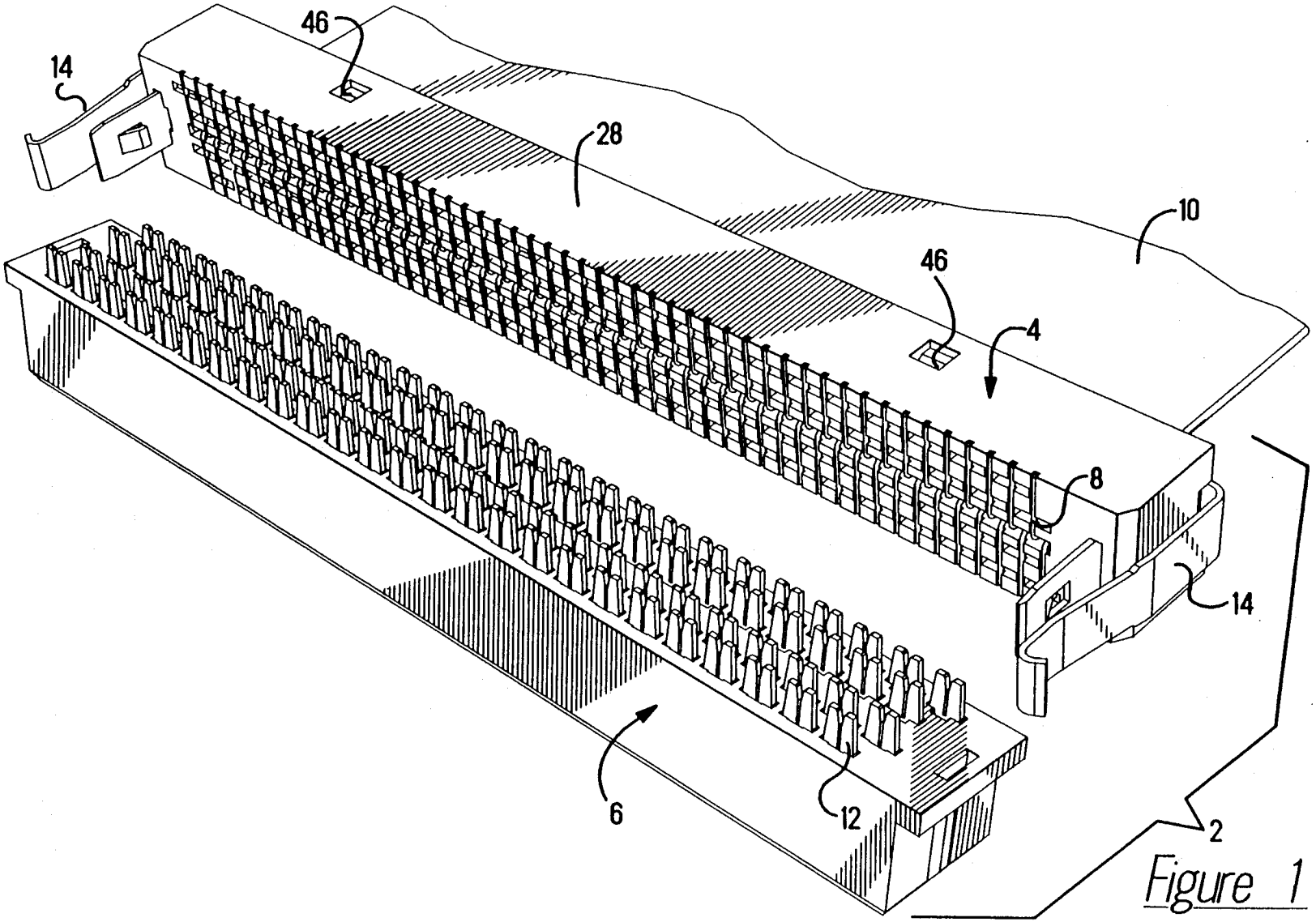
FIG. 1 is a perspective view showing the fixture assembly poised for interconnection with a receptacle assembly.

With reference first to FIG. 1, the invention relates to a high density receptacle shown generally at 2 designed to terminate a 100 position ribbon cable with 0.2 millimeter (mm) conductors on a 0.5 mm centerline spacing. As shown in FIG. 1, the receptacle 2 comprises a cable fixture assembly 4 and a receptacle housing 6. The fixture assembly 4 is profiled to accommodate the individual conductors 8 of a high density ribbon cable 10 such that the individual conductors can be terminated to conductor terminating slots shown generally at 12 in the receptacle housing 6. Clips 14 flanking the fixture assembly 4 are designed to retain the fixture assembly 4 to the receptacle assembly 6 and to provide for latching engagement with a mateable header assembly.

Figure 2:
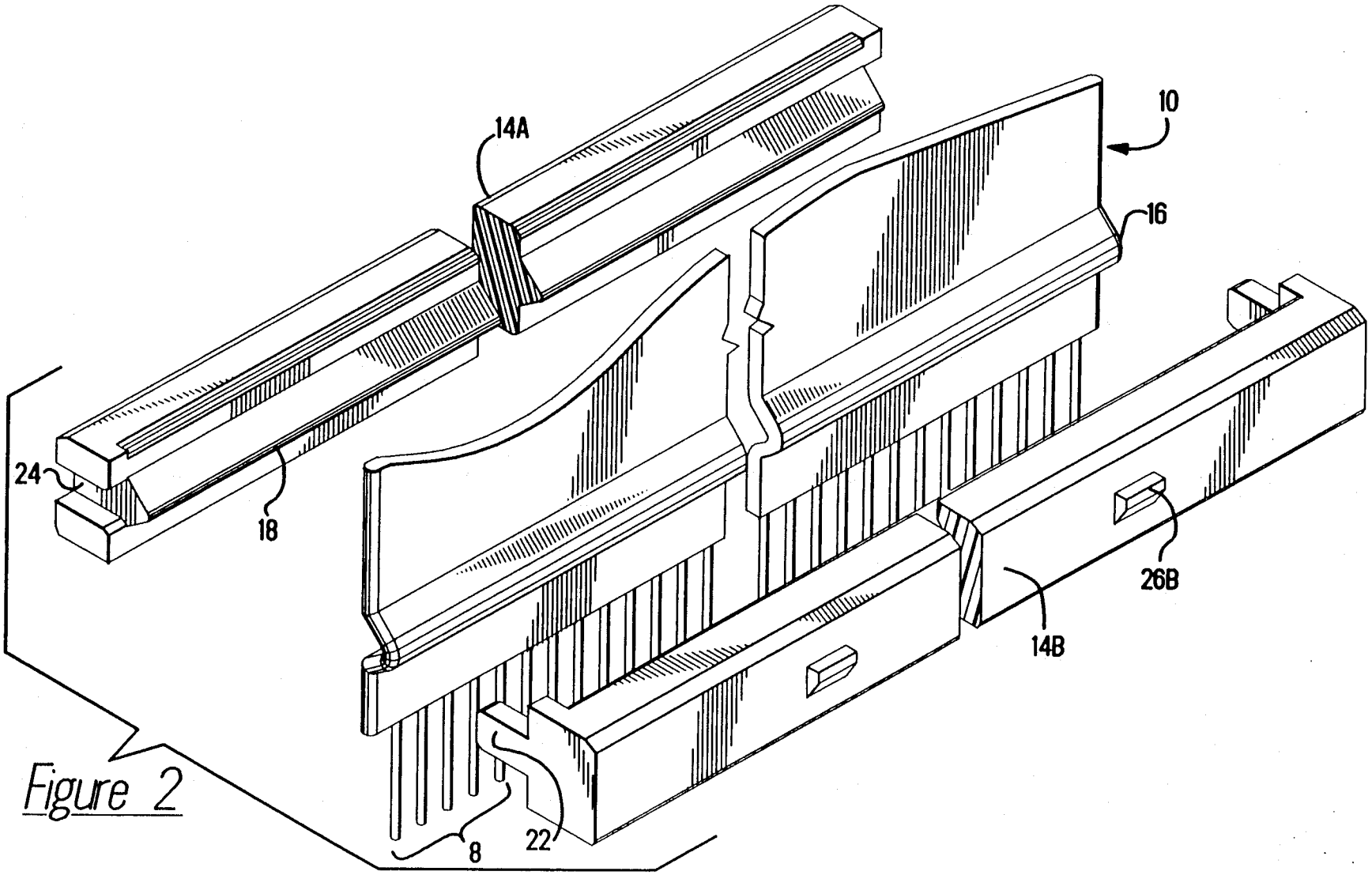
FIG. 2 is a perspective view showing strain relief halves disposed on opposite sides of a high density ribbon cable.
Figure 13:
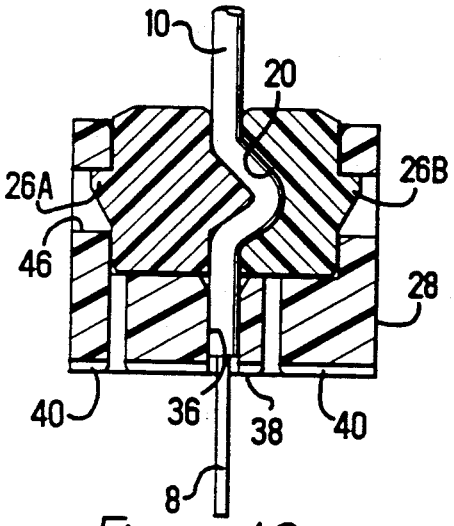
FIG. 13 shows a cross-sectional view of the fixture housing along lines 13—13 of FIG. 5, together with a cross-sectional view of the strain relief halves of FIG. 12.

With reference now to FIG. 2, the fixture assembly 4 comprises two strain relief halves **14*a* and 14*b* which trap between them the high density ribbon cable 10. As shown in FIG. 2, the ribbon cable 10 is prepared to include an undulation at 16, while the strain relief half 14*a* includes a V-shaped projection at 18 and the strain relief half 14*b* includes a concave indentation 20 along its length as shown in FIG. 13. The strain relief halves 14*a*, 14*b* further comprise guide posts 22 at the ends of the strain relief half 14*b* and cooperative slots 24 at the ends of the strain relief half 14*a*, to align the two halves properly together. The strain relief half 14*a* includes locking protrusions 26*a* while strain relief half 14*b* includes a locking protrusion 26*b* as shown in FIG. 13**.

Figure 3:
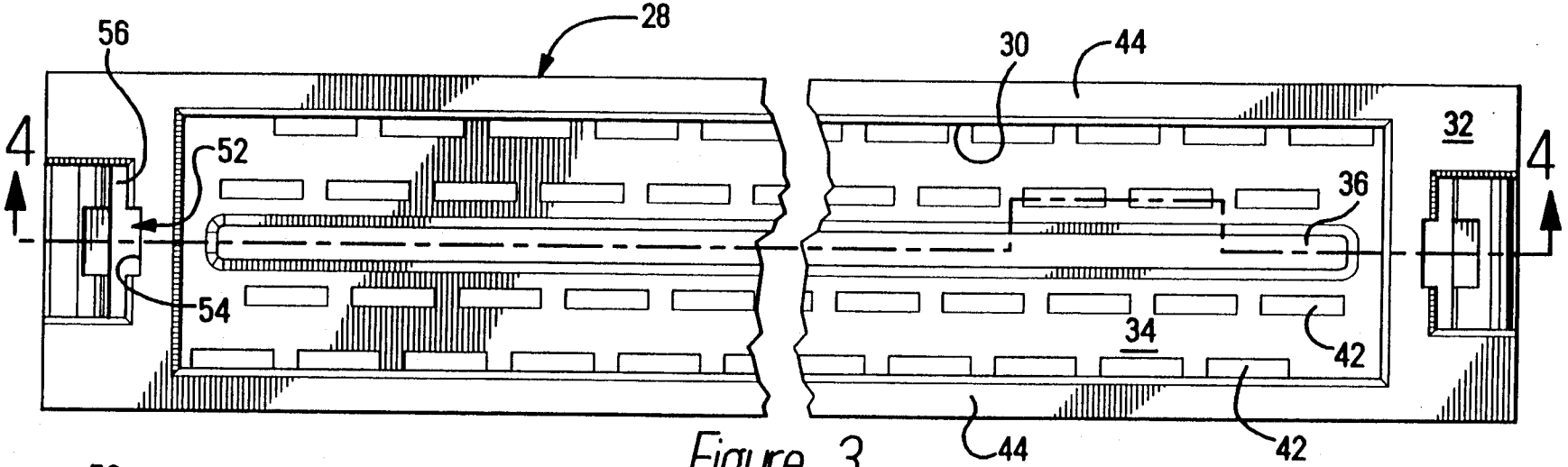
FIG. 3 is a top elevational view of the housing for the fixture assembly.
Figure 4:
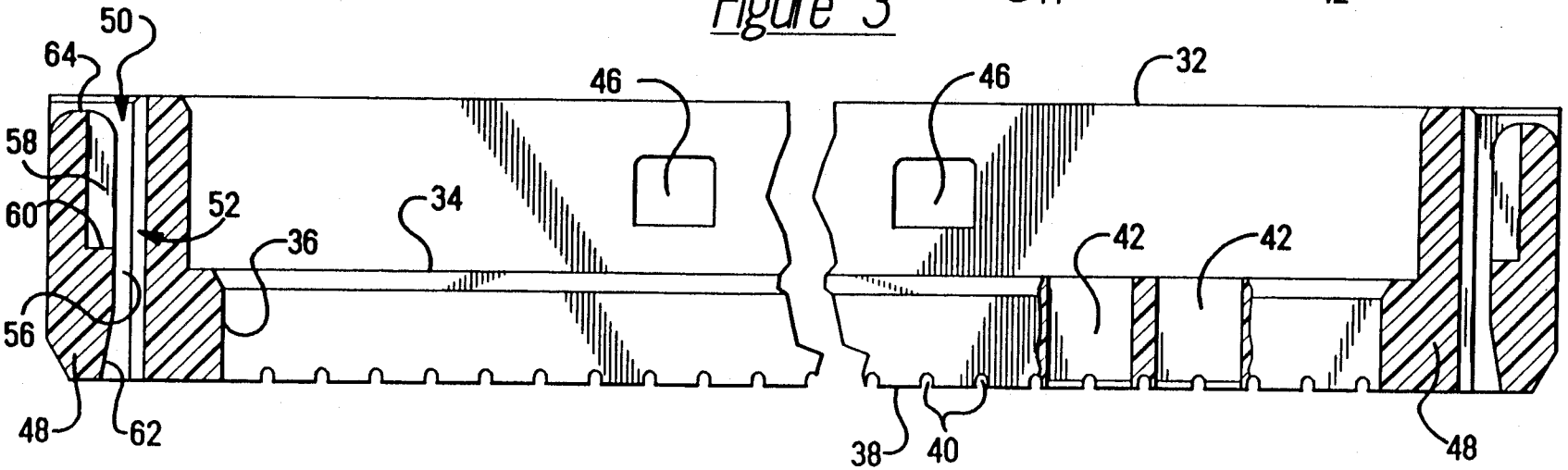
FIG. 4 is a cross-sectional view through lines 4—4 of FIG. 3.
Figure 5:
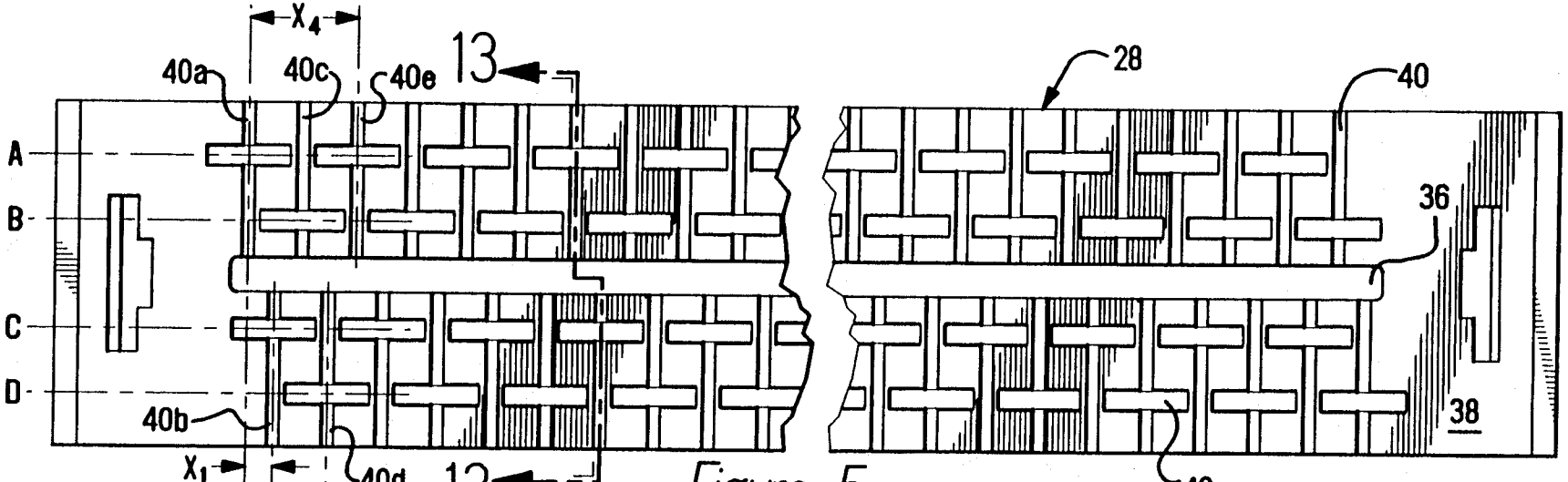
FIG. 5 is a bottom elevational view of the housing of FIGS. 3 and 4.

As shown in FIG. 1, the fixture assembly 4 further comprises an outer housing 28 into which the two strain relief halves **14*a* and 14*b* are inserted. With reference now to FIGS. 3–5, the outer housing 28 will be described in greater detail. The outer housing 28 includes a recessed cavity at 30 which is profiled to accommodate the two strain relief halves and the cable 10. As shown in FIG. 3, the recessed cavity 30 extends downwardly from an upper surface 32 to define a lower floor 34. As shown in FIGS. 3–5, a cable-receiving slot 36 is in communication with the cavity 30 and extends from the floor 34 to a lower surface 38 (FIG. 4**).

Figure 15:
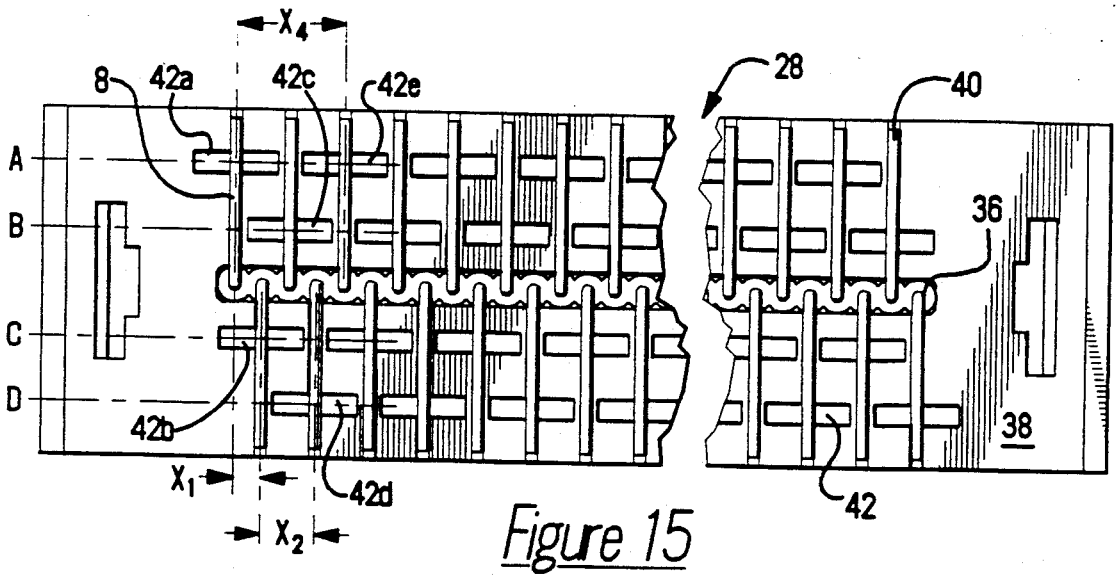
FIG. 15 is a bottom elevational view showing alternate conductors positioned in their respective grooves in the fixture housing.

With respect now to FIG. 5, the lower surface 38 of the housing 28 includes a plurality of wire locating grooves 40 emanating from both sides of the slot 36. As shown in FIGS. 4 and 5, the slots 40 are transversely coinciding with terminal receiving channels 42. As shown in FIG. 5, the terminal receiving channels 42 are positioned in two rows, A and B, on one side of the slot 36, and into two rows, C and D, on the opposite side of the slot 36. Groove **40*a* in row A is in the first lateral position, whereas groove 40*b* is in the second lateral position, and is located in row C on the opposite side of the slot 36. The third lateral position is groove 40*c* in row B whereas the fourth lateral position, groove 40*d*, is in row D. In this manner, by staggering between the rows A and B and by staggering to opposite sides of the slot 36 into the rows C and D, the lateral distance between adjacent grooves in the same row, for example, 40*a* and 40*e*, is equal to four times $X_1$, where $X_1$ is equal to the lateral position between consecutive positions, such as 40*a* and 40*b*. It should also be noted that $X_1$ is equal to the pitch of the conductors 8, as shown in FIG. 15**.

As shown in FIG. 4, the recessed cavity 30 defines two upstanding side walls 44 where each side wall includes an aperture 46 profiled to cooperate with locking projections 26a and 26b on the strain relief halves 14a and 14b, respectively. With reference still to FIG. 4, the recessed cavity 30 further defines end walls 48 having channels 50 therein. Channels 50 include a T-shaped slot 52 extending between the upper and lower surfaces 32 and 38 as best viewed in FIG. 4. The T-shaped slot 52 is comprised of a tab clearance slot portion 54 and a wide cross slot portion 56. The channel 50 further comprises a tab clearance slot 58 thereby defining an upwardly facing shoulder 60. As shown best in FIG. 4, the end of the through channel 56 has a beveled surface 62 thereby defining a relief area, which will be described in greater detail herein. As also shown best in FIG. 4, the end wall 48 includes curved outer surface 64 approaching the channel 50.

Figure 6:
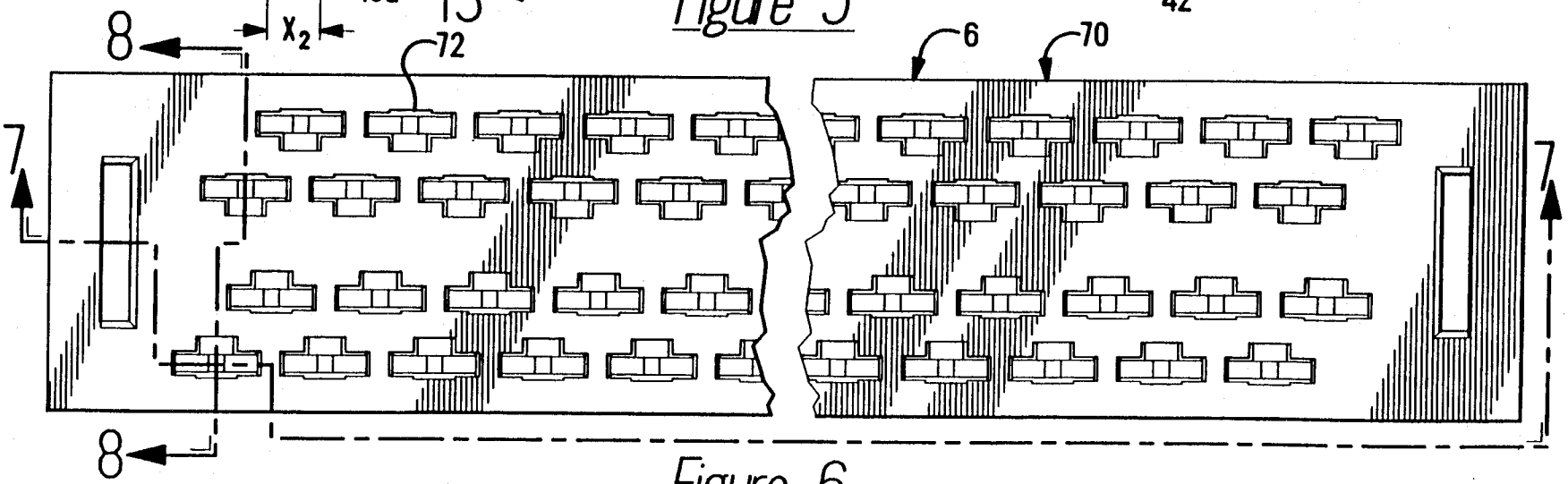
FIG. 6 is a top elevational view of the housing of the receptacle assembly.
Figure 7:
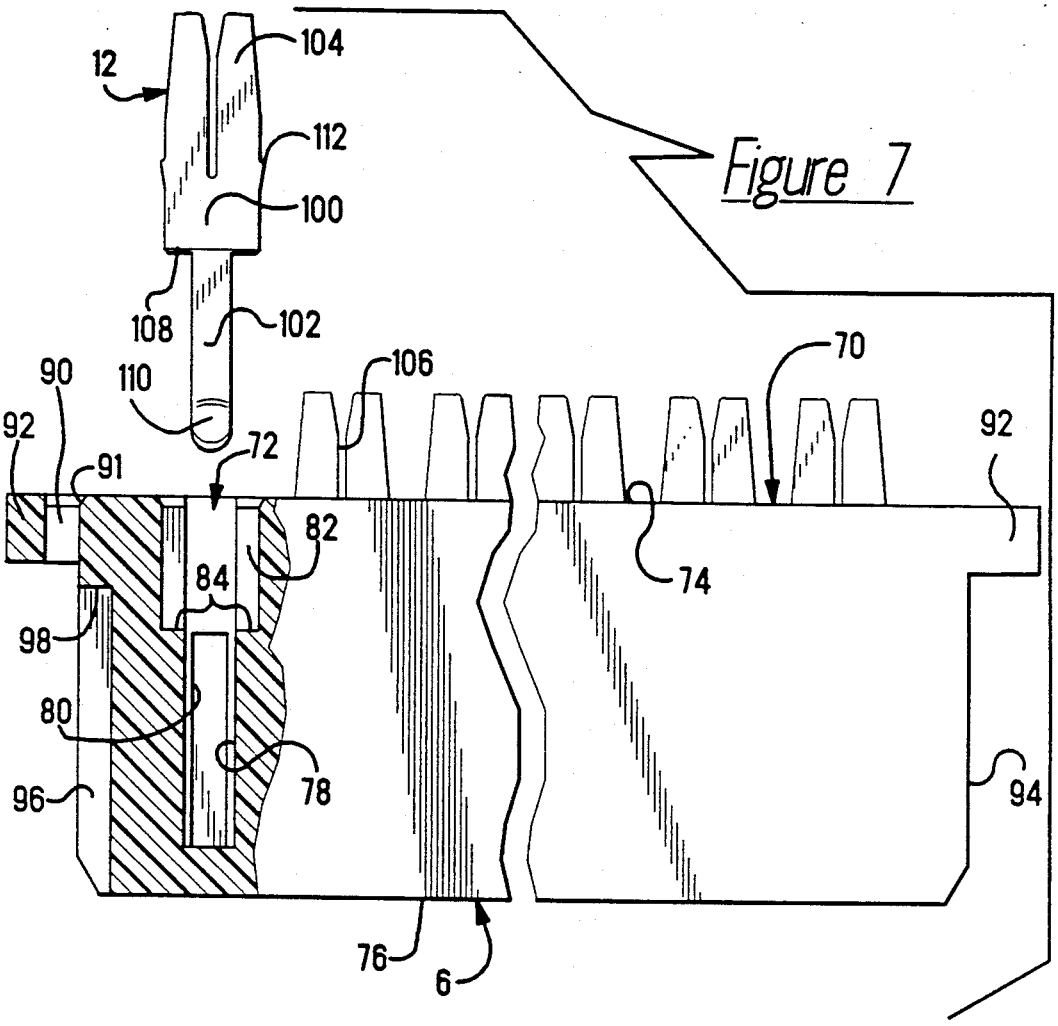
FIG. 7 is a partial cross-sectional view along lines 7—7 of FIG. 6.
Figure 8:
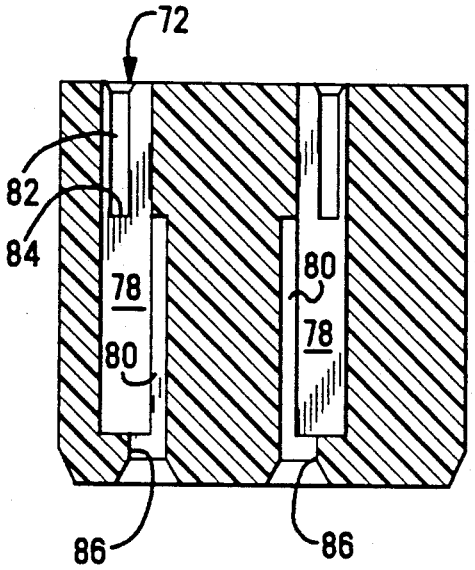
FIG. 8 is a cross-sectional view through lines 8—8 of FIG. 6.

With reference now to FIG. 6–9, the receptacle assembly 6, shown in FIG. 1, will be described in greater detail. With reference first to FIG. 6, the assembly includes a housing shown generally at 70 comprising a plurality of terminal receiving passageways 72 disposed in four discrete staggered rows. It should be appreciated from a comparison of FIGS. 5 and 6, that the array of the passageways 72 is a mirror image of the slots 42. As shown in FIG. 7, the slots extend between an inner surface 74 and an outer surface 76 of the housing 70. Each of the passageways 72 is defined by a square passageway 78 communicating with an off-center passageway 80 as best shown in FIG. 8. Extending downwardly from the upper surface 74 are transverse slots 82 which intersect the passageways 78 and extend only part way down thereby defining upwardly facing shoulders 84.

The off-center passageways 80 are continuous with post-receiving passageways 86 as shown best in FIG. 8. The receptacle housing 70 also includes through slots 90 extending through flanges 92 at the ends of the housing 70. The end walls 94 include clearance passageways 96 thereby defining downwardly facing shoulders 98 positioned below the slots 90. It should also be appreciated that the through slots 90 of the receptacle housing 6 are in alignment with the passageways 50 at the ends of the fixture housing.

Figure 14:
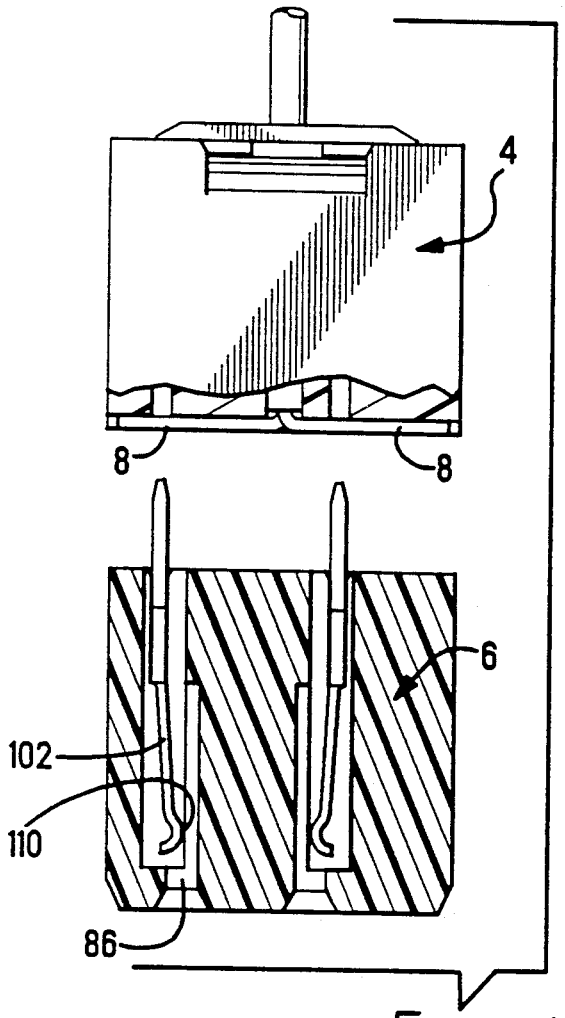
FIG. 14 shows a partial cross-sectional view of the fixture assembly, similar to that of FIG. 13, poised above the receptacle assembly of FIG. 8, with alternate conductors in the high density ribbon cable positioned on opposite sides of the housing.

With reference still to FIG. 7, a receptacle terminal for use in the receptacle housing 70 is shown generally at 12 and comprises a conductor terminating portion 100 integral with a receptacle portion 102. The conductor terminating portion 100 comprises upstanding bifurcated arms 104 spaced apart to define a conductor terminating slot 106. The intersection of the conductor terminating portion 100 and receptacle portion 102 defines a downwardly facing shoulder 108 on the terminal 12. The receptacle portion 102 is defined as a cantilever spring having a resilient contact portion 110 for disposition adjacent to the mating face 76 of the housing 70. As shown in FIG. 7, the terminals 12 are profiled for disposition into the terminal receiving passageways 72 such that the downwardly facing shoulder 108 on the terminal 12 abuts the upwardly facing shoulder 84 in the passageway, thereby positioning the resilient cantilever spring portion 102 within the passageway 78 adjacent to the face 76. As shown in FIG. 14, the cantilever spring portions 102 are angled slightly relative to the conductor terminating portions 100 such that the contact portions 110 extends into the profile of the passageway 80 for interconnection with a mating pin. As also shown in FIG. 7, the terminals 12 include retention barbs 112 along the side edges of the insulation displacement portion 100 thereby retaining the terminals 12 within their respective passageways 72.

Figure 10:
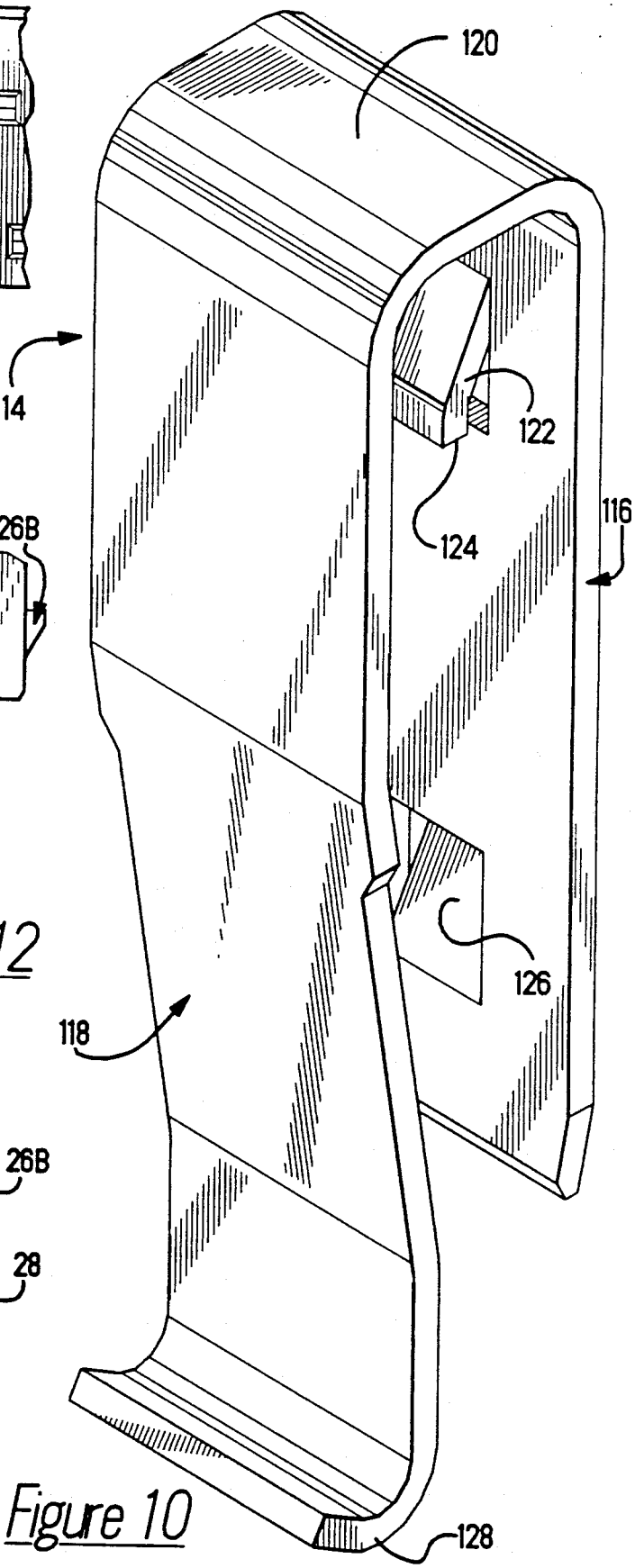
FIG. 10 is a perspective view of the spring latch used to retain the fixture assembly and receptacle assembly together.
Figures 17, 18, 19:
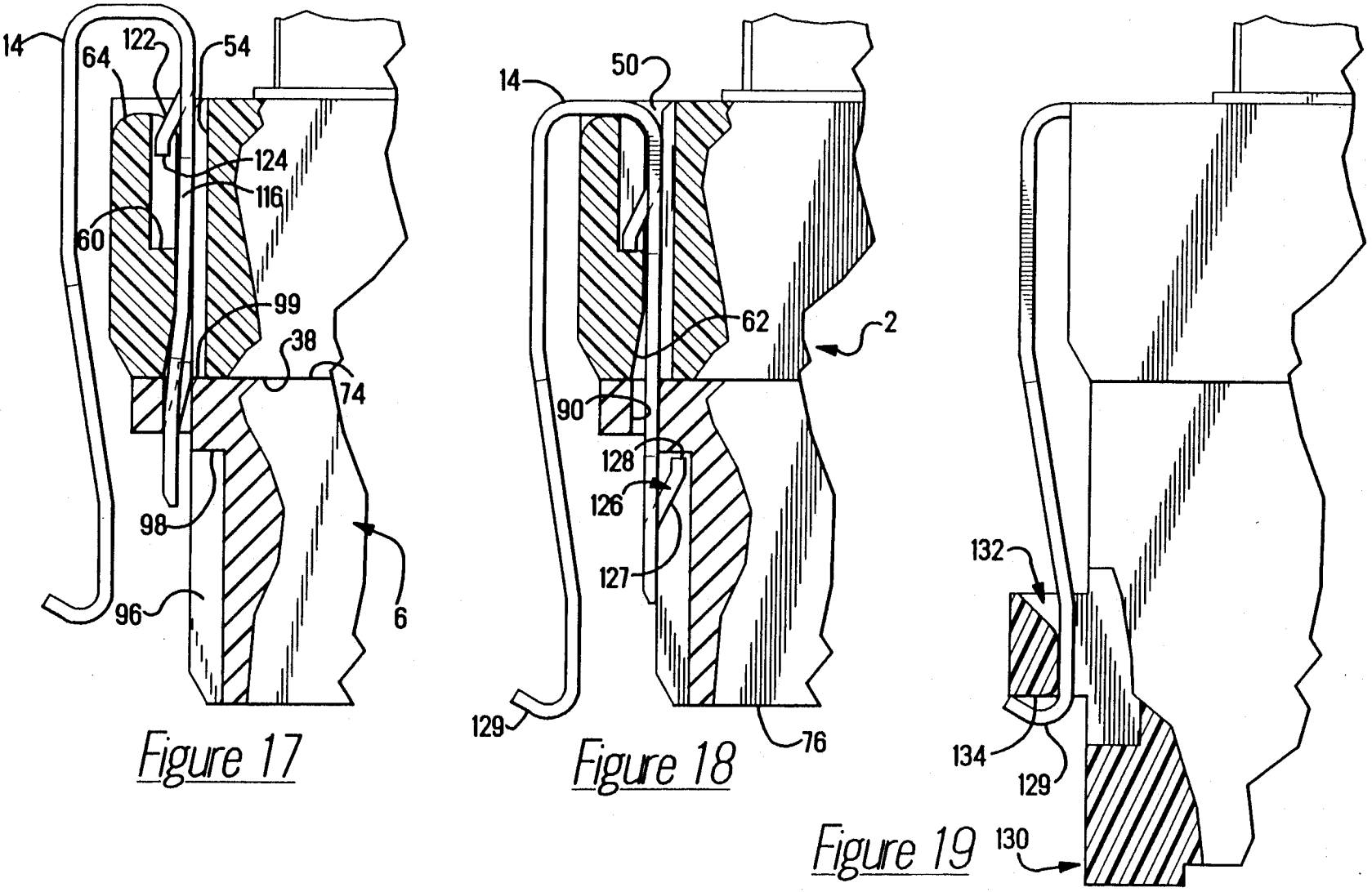
FIG. 17 is a partial cross-sectional view through one end of the fixture and receptacle housing showing the insertion of the spring latch.
FIG. 18 is a partial cross-sectional view, similar to that of FIG. 17, showing the spring latch in the fully inserted position.
FIG. 19 is a partial cross-sectional view showing the receptacle assembly in a mated configuration with a tab header.

With reference now to FIG. 10, a spring latch is shown generally at 14 for retaining the fixture assembly 4 and receptacle assembly 6 together. The spring latch 14 generally includes a base arm 116 interconnected to a spring clip section 118 via a bight portion 120. The base arm 116 includes an upper shear formed tab 122 which extends inwardly towards the spring clip section 118 defining a downwardly facing latch shoulder 124. A second lower shear formed tab 126 extends outwardly of the base plate section 116 to define an upwardly facing latching shoulder 128 (FIG. 18). The free end of the spring clip section 118 is reversely bent at its free end to define a hook member 128 for retaining the receptacle assembly 2 to a mating pin header as further described herein.

Figure 12:
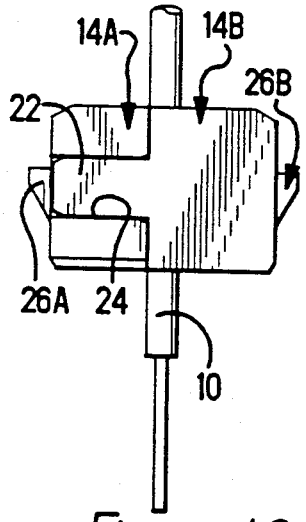
FIG. 12 shows the strain relief halves encompassing the formed ribbon cable.

With reference now to FIGS. 10–15, the assembly of the receptacle assembly 2 will be described in greater detail. While the assembly of the connector will be explained herein generally, the assembly is described in greater detail in co-filed patent application Ser. No. 660,797, filed on even date. As shown first in FIG. 11, the high density ribbon cable 10 is formed to define a kink at 16 and the ends of the cable are stripped to expose the individual conductors 8. The strain relief halves 14a and 14b, previously described with reference to FIG. 2, are offered up to the ribbon cable 10 in a transverse direction thereto, to entrap the cable and to position alignment posts 22 within the alignment slots 24. With the strain relief halves 14a, 14b and the ribbon cable 10, assembled as shown in FIG. 12, this assembly is positioned within the recessed cavity 30 of the housing 28 such that the ribbon cable 10 is disposed through the slot 36 to position the conductors 8 extending beyond the face 38, as shown in FIG. 13. The strain relief halves 14a, 14b are positioned into the recessed cavity such that the projections 26a and 26b are snapped into the apertures 46, as shown in FIG. 13. Conductors 8 are bent upwardly towards the face 38 to position alternating conductors 8 within the grooves 40.

Figure 16:
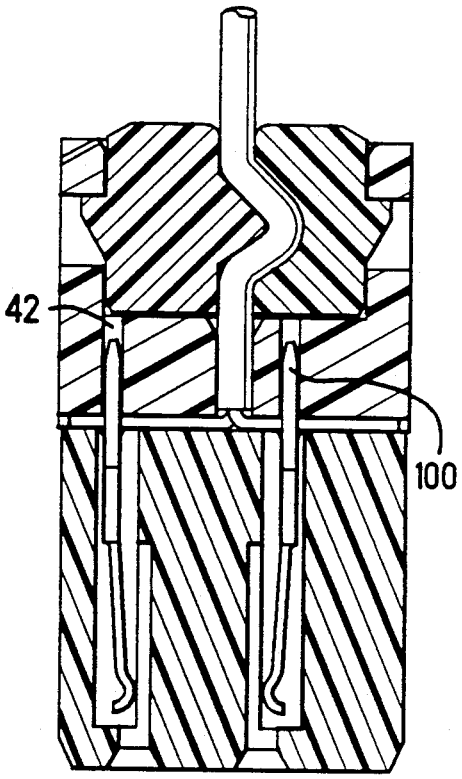
FIG. 16 is a cross-sectional view, similar to that of FIG. 14, showing the fixture and the receptacle assemblies in a mated configuration, with the individual conductors terminated.

As shown now in FIG. 15, with the conductors 8 positioned in the alignment grooves 40, the individual conductors 8, while positioned in a closely spaced array, can be terminated to the conductor terminating portions 100 of the terminals. As mentioned above, the centerline spacing, or pitch, ($X_1$) between adjacent conductors in the ribbon cable 10 is 0.5 mm. Even though the grooves 40 are spaced apart a distance $X_2$ equal to 1.0 mm, the slots 42b and 42d are staggered from row C to row D, increasing the centerline spacing between adjacent slots 42 in the same row. For example, as shown in FIG. 15, slots 42a and 42e in row A are adjacent slots in the same row and are spaced apart a distance $X_4$ equal to 2.0 mm (0.079 inches). With the individual conductors 8 positioned as shown in FIG. 15, the fixture assembly 4 and receptacle assembly 6 are now brought into abutting relation terminating the individual conductors 8 within the conductor terminating slots 106 (FIG. 7), as shown in FIG. 16. As mentioned previously, the slots 42 and 72 are mirror images of one another, allowing the upper sections of the conductor terminating portions 100 to project into an associated slot 42, as shown in FIG. 16.

With reference to FIGS. 17 and 18, the spring latch 14 is used to retain the fixture assembly 4 in the receptacle assembly 6 in the mated configuration shown previously in FIG. 16. It should be appreciated from FIG. 18 that the beveled or relief section 62 extends outwardly and the slot 90 is profiled, such that the outer surface of the slot is continuous with the leading edge of the beveled section 62, to form a continuous surface. As shown in FIG. 17, the upper surface 74 of the housing 70, forms an edge 99 facing upwardly into the narrow slot portion 54. Thus, the beveled section 62 in combination with the slot 90 allows the base section 116 carrying the shear formed tab 126 to move somewhat laterally to the left, as viewed in FIG. 17, into the relief section 62 upon insertion of the spring latch through the passageway 50. It should be noted from FIGS. 17 and 18 that the shear formed tab 126 includes a tab arm portion 127 which, as shown in FIG. 17, acts as a camming force against a beveled edge 91 (FIG. 7), to assist the base arm in moving into the relief area.

Figure 9:
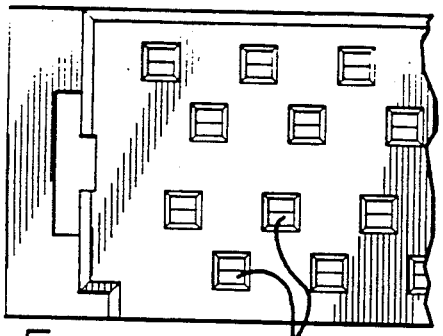
FIG. 9 is a partial top elevational view of the receptacle housing.
Figure 11:
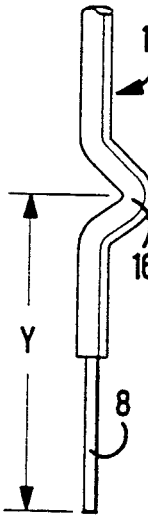
FIG. 11 shows a side view of the formed ribbon cable.

When the spring latch 14 is in the fully inserted position of FIG. 18, the shoulder 124 of the shear formed tab 122 is in abutment with the upwardly facing shoulder 60 in the channel 50 and the upwardly facing shoulder 128 of the shear formed tab 126 is in abutment with the shoulder 98 in the clearance channel 96. It should be appreciated then that, with the receptacle assembly assembled as shown in FIG. 2, the two spring hooks 129 are positioned at opposite ends of the mating face 76 for interconnection to a pin header shown generally at 130 in FIG. 19. As the receptacle assembly is moved into engagement with the pin header, the hooks 129 ride against a ramped upper surface of yoke 132. To release the receptacle assembly from the pin header, the hooks 129 are forced to slide across lower surfaces 134 until the hooks are no longer in engagement with the lower surfaces. While not specifically shown, it should be appreciated that the tab header 130 would include a plurality of upstanding posts disposed in an array of four rows profiled to match the openings 86 as shown in FIG. 9.

Thus, the objectives have been accomplished by way of a novel spring latch 14 for retaining two housing members together. By providing a relief area above the latching shoulder for the lower shear formed tab 126, the base arm carrying the lower shear formed tab is movable into the relief area, until such time as the lower shear formed tab passes the associated latching shoulder 98. In this manner, the base arm and shear formed tab can deflect away from the latching shoulder, and do not skive or broach material away from the channel. Furthermore, the channel for receiving the base arm includes a T-shaped slot where the base portion of the slot is narrow and is profiled to receive the shear formed tab therethrough. In this manner, the shear formed tab need not deflect until it reaches the end wall 92 carrying the latching shoulder.

While the form of apparatus herein described constitute a preferred embodiment of this invention, it is to be understood that the invention is not limited to this precise form of apparatus, and that changes may be made therein without departing from the scope of the invention which is defined in the appended claims.

What is claimed is:

1. An electrical connector comprising:

an insulative housing assembly comprised of first and second housing parts, said housing parts being adapted for mating abutment, one against the other, said housing parts having spring latching clips adjacent to ends of said housing parts to maintain said housing parts together and to latch said housing parts to a mateable connector, said first housing part having clip receiving channels at each end which are in alignment with clip receiving slots of said second housing part, said spring latching clips being receivable into and through said channels and slots for latching engagement therewith, for retaining said first and second housing parts in abutment, said spring latching clips being defined as a substantial U-shape, each having a base arm and a clip arm, said base arms being insertable through said clip receiving channels of said first part and into said clip receiving slots of said second part, said base arms having a shear formed tab extending out of the plane of the base arm, and having a latching edge facing said first part, said second housing part having latching shoulders below said slots, said shear formed tabs being engageable with said latching shoulders below said slot to retain said housing parts together, said first and second housing parts having a relief area above said latching shoulder on the opposite side as said shear formed tab, said base arm being resiliently deflectable into said relief area upon insertion of said base arm into said channels and slots, and resiliently movable back when said shear formed tab has cleared said latching shoulder.

2. The electrical connector of claim 1, wherein said shear formed tab includes a tab arm portion extending obliquely towards said first housing part, said tab arm portion being adapted to cam said base arm into said relief area, upon insertion of said spring latching clips.

3. The electrical connector of claim 2, wherein said clip receiving channels further comprise tab clearance slots, at least as wide as said shear formed tabs, extending the length of said clip receiving channels.

4. The electrical connector-of claim 3, wherein said clip receiving channels include enlarged openings at a mouth of said clip receiving channel, proximate said clip receiving slot, and on an opposite side of said channel as said tab clearance slots.

5. The electrical connector of claim 4, wherein said first and second housing parts are mated along mutually abutting faces.

6. The electrical connector of claim 5, wherein said enlarged opening is formed by a beveled surface extending upwardly from said abutting face of said first housing part.

7. The electrical connector of claim 6, wherein said clip receiving slots are as wide as said enlarged mouths of said clip receiving channels, whereby said beveled surfaces form continuous surfaces with outer sides of said clip receiving slots.

8. The electrical connector of claim 4, wherein said shear formed tabs and base arms are together resiliently deflectable, whereby upon insertion of said spring latching clips through said clip receiving channels and clip receiving slots, said base arms are deflectable into. said enlarged mouth, until such time as said shear formed tab clears said latching shoulder, whereupon said base arms are deflectable away from said enlarged mouth to position said latching edge against said latching shoulder.

9. An electrical connector comprising:

an insulative housing assembly comprised of first and second housing parts being adapted for mating abutment, said housing parts having spring latching clips adjacent to ends of said housing parts to retain said housing parts together and to latch said housing parts to a mateable connector, said first housing part having clip receiving channels at each end which are in alignment with clip receiving slots of said second housing part, said spring latching clips being defined as a substantial U-shape having a base arm and a spring arm, said base arm being insertable through said clip receiving channel of said first part and into said clip receiving slots of said second part, said base arm having a shear formed tab extending out of the plane of the base arm, and having a latching edge facing said first part, said latching edge being engageable with a latching shoulder below said slot on said second housing part, said first and second housing parts having a relief area above said latching shoulder on the opposite side as said shear formed tab, said base arm being resiliently movable into said relief area upon insertion of said base arm into said channels and slots, and resiliently movable back when said shear formed tab has cleared said latching shoulder.

10. The electrical connector of claim 9, wherein said clip receiving channel is defined as a substantial T-shape, having a wide section adapted to receive said base arm, and a narrow section adapted to receive said shear formed tab.

11. The electrical connector of claim 10, wherein an inner surface of said widened section is aligned with an inner surface of said clip receiving slot, said inner surface forming an edge facing upwardly into said narrow section.

12. The electrical connector of claim 11, wherein an outer surface of said clip receiving slot is aligned with a leading edge forming said relief area.

13. The electrical connector of claim 9, further comprising a second shear formed arm having a latching edge facing said second housing part, and said first housing part including a second latching shoulder cooperable with said second shear formed arm.

14. The electrical connector of claim 13, wherein said second latching shoulder is integral with said clip receiving channel.

15. The electrical connector of claim 14, wherein said second shear formed arm extends from an opposite side of said base arm as said first shear formed arm.

16. An electrical connector comprising:

an insulative housing assembly comprised of first and second housing parts having a plurality of electrical terminals positioned therein, said housing parts being adapted for mating engagement along mutually abutting faces, said housing parts having latching clips adjacent to ends of said housing parts to maintain said housing parts together, said latching clips comprising a base arm having a lower shear formed tab extending out of a plane of said base arm having a latching edge facing said first part, said first housing part having T-shaped clip receiving channels at each end comprised of cross slots and first tab clearance slots, where said cross slots are in alignment with clip receiving slots of said second housing part, said latching clips being insertable through said clip receiving channels of said first part with said base arms passing through said cross slots and said lower shear formed tabs passing through said first tab clearance slots, said lower shear formed tabs being engageable with a latching shoulder below said clip receiving slots of said second housing part, said first housing part further comprising a second tab clearance slot on the opposite side as said first tab clearance slot, said second tab clearance slot extending part-way through said housing forming an upwardly directed shoulder, said base arm including an upper shear formed tab in abutment with said upwardly directed shoulder.

17. The electrical connector of claim 16, wherein said first and second housing parts have a relief area above said latching shoulder on the opposite side as said lower shear formed tabs, said base arm being resiliently movable into said relief area upon insertion of said base arm into said channels and slots, and resiliently movable back when said lower shear formed tabs have cleared said latching shoulders.

18. The electrical connector of claim 17, wherein said relief area is defined by a beveled edge in said clip receiving channel of said first housing part forming a widened mouth opening onto said abutting face of said first housing part, and each said clip receiving slot of said second housing part having a width equal to said widened mouth.

19. The electrical connector of claim 18, wherein said clip receiving slots of said second housing part, having camming edges directly below said tab clearance slots, adapted to cam said base arms into said relief areas upon insertion of said latching clips, allowing said shear formed tabs to clear said latching edges of said second housing part.

20. The electrical connector of claim 16, wherein said latching clips are U-shaped comprising spring clip arms in addition to said base arms, said spring clip arms positioned on the exterior of said first housing part and generally directed toward said first housing part.

21. The electrical connector of claim 20, wherein said spring clip arms are deflectable towards and away from said first and second housing parts, and have latching hooks adjacent to free ends thereof, adapted to connect said first and second housing parts to a mating connector.

* * * * *